US009856651B2

(12) United States Patent
Letts et al.

(10) Patent No.: US 9,856,651 B2
(45) Date of Patent: Jan. 2, 2018

(54) FASTENING PLATE ASSEMBLY

(75) Inventors: John B. Letts, Carmel, IN (US); Timothy Tackett, Sheridan, IN (US); Allen Sopko, Westfield, IN (US); Michael Hubbard, Goshen, IN (US); John Geary, Carmel, IN (US)

(73) Assignee: Firestone Building Products Co., LLC, Nashville, TN (US)

( * ) Notice: Subject to any disclaimer, the term of this patent is extended or adjusted under 35 U.S.C. 154(b) by 312 days.

(21) Appl. No.: 13/482,187

(22) Filed: May 29, 2012

(65) Prior Publication Data

US 2012/0311951 A1 Dec. 13, 2012

Related U.S. Application Data

(60) Provisional application No. 61/490,824, filed on May 27, 2011.

(51) Int. Cl.
*E04D 3/36* (2006.01)
*E04D 5/14* (2006.01)

(52) U.S. Cl.
CPC ..... *E04D 3/3606* (2013.01); *E04D 3/3603* (2013.01); *E04D 5/143* (2013.01); *E04D 5/145* (2013.01)

(58) Field of Classification Search
CPC .... E04D 1/06; E04D 1/34; E04D 1/36; E04D 3/36; E04D 3/3601; E04D 3/3603; E04D 3/3606; E04D 5/14; E04D 5/144; E04D 5/145; E04D 5/147; E04D 2001/34; E04D 2001/3423; E04D 2001/3411; E04D 2001/3438; F16B 43/001
USPC .. 52/410, 582.1, 587.1, 585.1, 126.6, 126.7, 52/512; 411/531, 533, 368
See application file for complete search history.

(56) References Cited

U.S. PATENT DOCUMENTS

| | | | | |
|---|---|---|---|---|
| 4,074,492 | A * | 2/1978 | Simpson et al. | 52/419 |
| 4,619,094 | A * | 10/1986 | Yang | 52/410 |
| 4,663,910 | A | 5/1987 | Hasan | |
| 4,712,959 | A | 12/1987 | Hasan | |
| 4,736,555 | A * | 4/1988 | Nagare et al. | 52/126.6 |
| 4,757,661 | A | 7/1988 | Hasan | |
| 4,834,600 | A | 5/1989 | Lemke | |
| 4,862,664 | A | 9/1989 | Romine | |
| 4,996,803 | A | 3/1991 | Karrfalt et al. | |

(Continued)

OTHER PUBLICATIONS

"Insulation Attachment Patterns", Technical Information Sheet 950, S723-RFS-075, Firestone Building Products, dated May 22, 2008; 2 pages.

(Continued)

*Primary Examiner* — Jessica Laux
(74) *Attorney, Agent, or Firm* — Thomas R. Kingsbury; Arthur M. Reginelli

(57) ABSTRACT

A roofing system includes a construction board positioned over a roof deck and a plurality of fastening plates positioned on a top surface of the construction board. At least one connector extends between two of the plurality of fastening plates and is positioned on the top surface of the construction board. The construction boards may be insulation or cover boards, and in certain embodiments may be polyisocyanurate boards. Fasteners are driven through the fastening plates and the construction boards and into an underlying roof deck to secure the construction boards in place.

19 Claims, 4 Drawing Sheets

(56) References Cited

U.S. PATENT DOCUMENTS

| | | | | |
|---|---|---|---|---|
| 5,035,028 | A * | 7/1991 | Lemke | 24/336 |
| 5,069,589 | A * | 12/1991 | Lemke | 411/533 |
| 5,675,950 | A * | 10/1997 | Schilham | 52/263 |
| 5,707,181 | A | 1/1998 | von Allmen et al. | |
| 5,755,545 | A * | 5/1998 | Banks | 411/482 |
| 5,772,816 | A * | 6/1998 | Hubbard | 156/71 |
| 5,791,096 | A * | 8/1998 | Chen | 52/126.6 |
| 5,797,232 | A * | 8/1998 | Larson | 52/408 |
| 5,908,278 | A | 6/1999 | Hasan et al. | |
| 6,308,483 | B1 | 10/2001 | Romine | |
| 6,558,098 | B1 | 5/2003 | Angehrn et al. | |
| 6,565,303 | B1 | 5/2003 | Riccitelli et al. | |
| 7,320,179 | B2 | 1/2008 | Tiemann et al. | |
| 7,413,392 | B2 * | 8/2008 | Nebesnak et al. | 411/531 |
| 7,650,726 | B2 * | 1/2010 | Jakob-Bamberg et al. | 52/263 |
| 7,918,059 | B2 * | 4/2011 | Repasky | 52/263 |
| 8,336,275 | B2 * | 12/2012 | Rodenhouse | 52/741.3 |
| 2003/0126816 | A1 * | 7/2003 | Hasan et al. | 52/409 |
| 2004/0168396 | A1 * | 9/2004 | Kuhn et al. | 52/698 |
| 2004/0187420 | A1 * | 9/2004 | Bernardi et al. | 52/410 |
| 2008/0196253 | A1 * | 8/2008 | Ezra et al. | 30/124 |
| 2010/0147471 | A1 * | 6/2010 | Bull | 160/381 |
| 2011/0078973 | A1 * | 4/2011 | Oberg | 52/582.1 |
| 2012/0240484 | A1 * | 9/2012 | Blom et al. | 52/126.7 |
| 2012/0291369 | A1 * | 11/2012 | Knight et al. | 52/126.6 |

OTHER PUBLICATIONS

"Insulation Fastening Plate", Technical Information Sheet 1106, S723-RFS-099, Firestone Building Products, dated Oct. 22, 2009; 1 page.

* cited by examiner

FASTENING PLATE ASSEMBLY

This application claims priority from Provisional Patent Application Ser. No. 61/490,824, filed on May 27, 2011, which is incorporated herein by reference in its entirety.

FIELD OF THE INVENTION

One or more embodiments of the present invention relate to a fastening plate assembly for use in a roofing system. In certain embodiments, the fastening plate assembly may secure one or more construction boards to a roof deck and may include a plurality of connecting members extending between a plurality of fastening plates.

BACKGROUND OF THE INVENTION

The construction industry commonly uses modified bitumen membranes or single ply membranes to provide a waterproof barrier on flat or low-slope roofs. An insulation or protective layer formed from construction boards is often provided over the roof deck and under the membranes. The most common construction boards are made of polyisocyanurate, also referred to as iso boards, and may be coated with a protective facer that can be either rigid or flexible and can be fire or flame retardant. The construction boards provide thermal insulation and a uniform surface over which the membranes are installed.

Construction boards are conventionally secured to the roof deck by fasteners passing through the construction board and into the roof deck. A fastening plate, also referred to as an insulation plate, is often provided on a top surface of the construction board, and includes a hole through which the fastener is received. The fastening plate provides a larger surface area of contact with the top surface of the construction board to improve the wind uplift resistance of the construction board. Fastening plates are available commercially in a wide variety of forms, but are often circular in shape and may have a diameter of approximately 3 inches. The fastening plates may include ribs or other strengthening devices to improve the rigidity of the fastening plate.

Due to the wind uplift forces experienced on many roof surfaces, it is often necessary to provide a large number of fastening plates and fasteners to adequately secure the construction board to the roof deck. For example, a construction board that is 4 feet by 4 feet may require as many as 16 fastening plates and fasteners to adequately secure it to a roof deck. Similarly, a construction board that is 8 feet by 4 feet may require as many as 32 fastening plates and fasteners to adequately secure it to a roof deck. The wind uplift resistance of a construction board secured with fastening plates and fasteners is also dependent upon the location and spacing of the fastening plates during installation. Thus, weak areas that are susceptible to failure may be created during installation if roofing technicians do not correctly locate and space the fastening plates and fasteners in the construction board. When a weak point is created, and one fastening plate fails, additional stress is placed upon adjacent fastening plates, and failure of the entire roofing assembly then becomes more likely.

Thus, there is a need for an improved fastening plate assembly that provides better wind uplift resistance of a construction board.

SUMMARY OF THE INVENTION

One or more embodiments of the present invention provide a fastening plate assembly comprising: a plurality of fastening plates; and at least one connector extending between two of said plurality of fastening plates.

One or more embodiments of the present invention also provides a roofing system comprising: a construction board positioned over a roof deck; a plurality of fastening plates positioned on a top surface of said construction board; and at least one connector extending between two of said plurality of fastening plates and positioned on said top surface of said construction board.

One or more embodiments of the present invention also provides a method of installing construction boards over a roof deck as part of a roofing system, the method comprising the steps of: positioning a construction board on a roof deck; positioning a fastening plate assembly over the construction board, the fastening plate assembly including a plurality of fastening plates and at least one connector extending between two of the fastening plates, the fastening plates including an aperture therethrough; driving a fastener through the aperture in each fastening plate and the construction board and into the roof deck.

DETAILED DESCRIPTION OF THE ILLUSTRATIVE EMBODIMENTS

In one or more embodiments, the fastening plate assembly of the present invention includes a plurality of fastening plates and one or more connectors extending between the fastening plates. The fastening plate assembly may be used to secure one or more construction boards over a roof deck. The fastening plate assembly of this invention advantageously increases the wind uplift resistance of the construction boards. In addition, proper placement of the fastening plates on the construction boards is ensured because the connectors will not allow for significant deviation from the preferred spacing.

Figure 1:
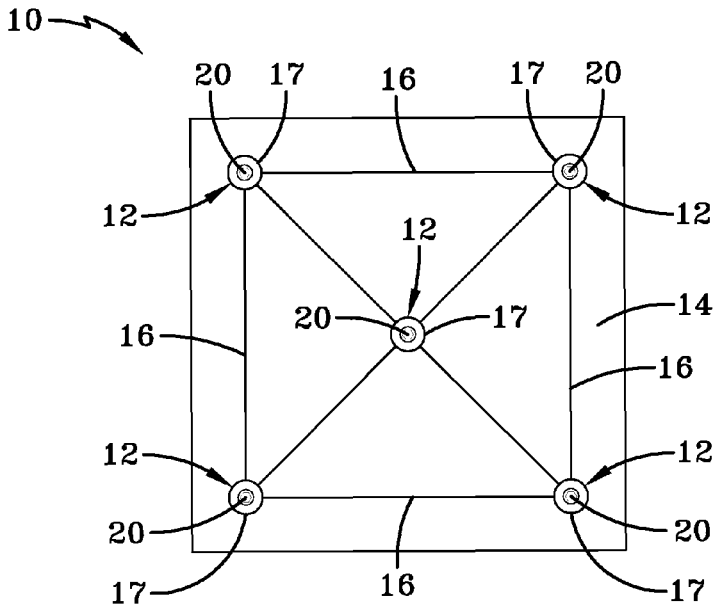
FIG. 1 is a top elevational view of a construction board and a fastening plate assembly according to the concepts of the present invention.

Referring now to FIG. 1, a fastening plate assembly is shown and is generally indicated by the numeral 10. Fastening plate assembly 10 includes a plurality of spaced fastening plates 12. In one or more embodiments, connectors 16 extend between one or more adjacent fastening plates 12.

Fastening plates 12 may be of any desired size and shape suitable for positioning over a construction board. In one or more embodiments, fastening plates 12 may be generally circular in shape. In other embodiments, fastening plates 12 may be generally square or rectangular in shape. In certain embodiments, fastening plates 12 may be made of a metal. In one or more embodiments, fastening plates 12 include a hole 18 therethrough to receive a fastener 20. Hole 18 may be sized and shaped to receive the intended fastener. Any known fastener may be used to secure the fastening plate to the underlying roof deck. Examples of conventional fastening plates are disclosed in U.S. Pat. Nos. 5,908,278; 5,707,181; 4,757,661; 4,712,959; 4,663,910; 6,558,098; 6,565,303; 7,320,179; 5,069,589; 4,862,664; and 4,834,600.

In one or more embodiments, the fastening plates 12 may be secured to and positioned over construction boards 14 that are arranged on a roof deck 19. In certain embodiments the fastening plates 12 may be secured by the fasteners 20 received therethrough. The construction boards 14 may be any known type of board positioned over a roofing surface for the purpose of protecting and/or insulating the structure, or supporting the roofing assembly. In one or more embodiments, construction boards 14 may be formed from low density polyisocyanurate, expanded polystyrene, extruded polystyrene, and/or phenolic to create insulation boards. In other embodiments, construction boards 14 may be formed from high density polyisocyanurate, wood fiber, perlite, and gypsum and other known materials used to create rigid cover boards.

In certain embodiments, construction boards 14 may be low density polyisocyanurate boards, which are also referred to as insulation boards. In one or more embodiments, the insulation boards may be characterized by a foam density (ASTM C303) that is less than 2.5 pounds per cubic foot (12 kg/m$^2$), in other embodiments less than 2.0 pounds per cubic foot (9.8 kg/m$^2$), in other embodiments less than 1.9 pounds per cubic foot (9.3 kg/m$^2$), and still in other embodiments less than 1.8 pounds per cubic foot (8.8 kg/m$^2$). In one or more embodiments, the insulation boards are characterized by having a density that is greater than 1.50 pounds per cubic foot (7.32 kg/m$^2$), or in other embodiments greater than 1.55 pounds per cubic foot (7.57 kg/m$^2$).

Where the density of the insulation boards is less than 2.5 pounds per cubic foot, it may be advantageous for the insulation board to be characterized by having an index of at least 120, in other embodiments at least 150, in other embodiments at least 175, in other embodiments at least 200, and in other embodiments at least 225, as determined by PIR/PUR ratio as determined by IR spectroscopy using standard foams of known index (note that ratio of 3 PIR/PUR provides an ISO Index of 300). Foam construction boards of similar nature are described in U.S. Pat. Nos. 7,612,120, 7,387,753, 7,838,568, 6,774,071, 6,372,811, 6,117,375, 6,044,604, 5,891,563, 5,573,092, U.S. Patent Application Publication Nos. 2004/0109983, 2003/0082365, and 2003/0153656, which are incorporated herein by reference.

In other embodiments, construction boards 14 may be high density polyisocyanurate boards, which are also referred to as cover boards. In one or more embodiments, the cover boards may be characterized by a density that is greater than 2.5 pounds per cubic foot (12.2 kg/m$^2$), as determined according to ASTM C303, in other embodiments the density is greater than 2.8 pounds per cubic foot (13.7 kg/m$^2$), in other embodiments greater than 3.0 pounds per cubic foot (14.6 kg/m$^2$), and still in other embodiments greater than 3.5 pounds per cubic foot (17.1 kg/m$^2$). In one or more embodiments, the density of the cover boards may be less than 20 pounds per cubic foot (97.6 kg/m$^2$), in other embodiments less than 10 pounds per cubic foot (48.8 kg/m$^2$), in other embodiments less than 6 pounds per cubic foot (29.3 kg/m$^2$), and in other embodiments less than 5.5 pounds per cubic foot (26.9 kg/m$^2$). Foam construction boards of similar nature are described in U.S. Pat. No. 7,972,688 and U.S. Patent Application Publication No. 2010/0031603, which are incorporated herein by reference.

In certain embodiments, the construction boards 14 may be sized to a 4 foot by 8 foot sheet (e.g., 3.75 feet by 7.75 feet), a 4 foot by 10 foot sheet, or a 4 foot by 4 foot sheet. In one or more embodiments, the thickness of the construction boards 14 may be greater than about 0.5 inches. In other embodiments, the thickness of the construction boards 14 may be from about 0.375 to 4.5 inches, or in other embodiments from about 1.0 to 4.0 inches in thickness.

In one or more embodiments, construction board 14 may include a facer on one surface thereof. In other embodiments, construction board 14 may include a facer on opposing planar surfaces. The facers may include any suitable materials known to those skilled in the art and suitable for the intended purpose. For example, the art teaches cellulosic, foil, and fiberglass facers. In certain embodiments, a cellulosic facer may be provided with a water resistant coating, as disclosed in co-pending PCT application serial no. PCT/US11/32461.

The number of fastening plates 12 utilized to secure a single construction board may vary depending upon the size of the construction board, the materials used to form the construction board and facer (if provided), and the wind uplift resistance required for the specific roofing assembly being installed. For example, a construction board 14 that is approximately 4 foot by 4 foot may be secured by between 4 and 16 fastening plates. Similarly, a construction board 14 that is approximately 4 foot by 8 foot may be secured by between 5 and 32 fastening plates.

In one or more embodiments, fastening plates 12 may be spaced on construction boards 14 to form recommended patterns, which may provide improved wind uplift resistance. For example, a recommended pattern for fastening plates 12 on a 4 foot by 4 foot construction board 14 may include fastening plates 12 positioned at each corner approximately 12 inches from each edge, and at a center of the construction board 14, as shown in FIG. 1. Similarly, a recommended pattern for fastening plates 12 on a 4 foot by 8 foot construction board 14' may include fastening plates 12 positioned as shown by the fastening plate assembly generally indicated by the numeral 10' in FIG. 2.

Figure 3A:
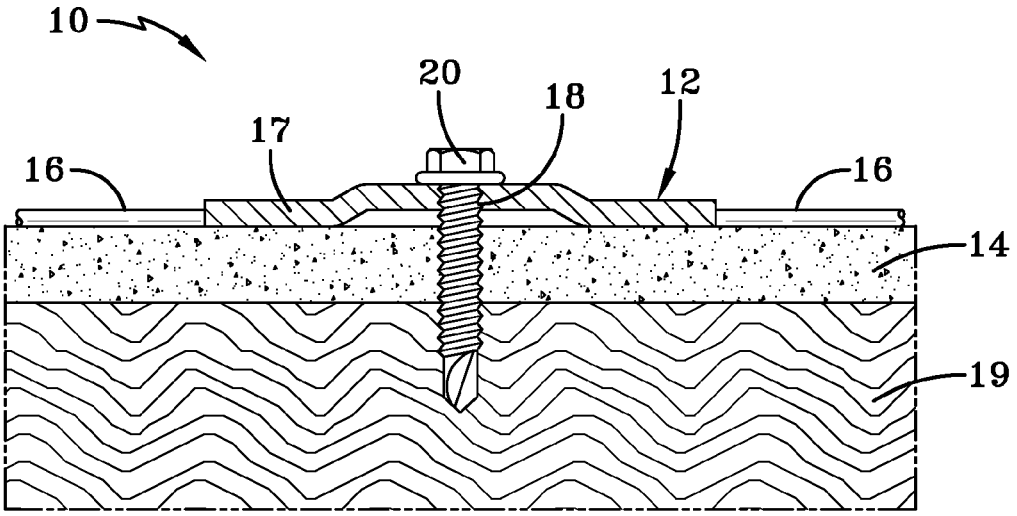
FIG. 3A is a sectional view of a portion of a fastening plate assembly according to the concepts of the present invention.
Figure 3B:
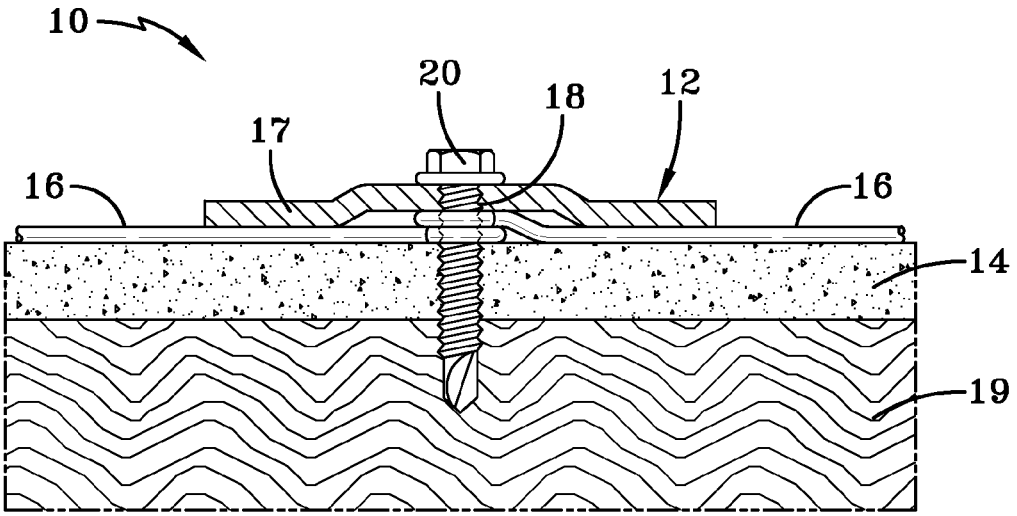
FIG. 3B is a sectional view of a portion of the fastening plate assembly showing an alternative connection mechanism for the connectors.

Connectors 16 extend between two fastening plates, thereby connecting the fastening plates to one another. In one or more embodiments, and as shown in FIG. 3A, connectors 16 may be attached directly to the fastening plates 12 by any method or mechanism known to those skilled in the art. For example, where connectors 16 are metal, they may be welded to an outer circumference of fastening plates 12. In other embodiments, and as shown in FIG. 3B, connectors 16 may be looped around the fasteners 20 received in fastening plates 12. While FIG. 3B shows connectors 16 looped around fasteners 20 below plate 17, it is also contemplated that connectors 16 may be looped around fasteners 20 adjacent the upper surface of plate 17. It is also contemplated that, where connectors 16 extend below fastening plates 12, a recess or holes may be provided to receive connectors 16 and allow plate 17 to rest flush on the upper surface of the construction board 14.

In one or more embodiments, connectors 16 may be a metal wire capable of manipulation. In certain embodiments, the wire connectors may have a diameter of between approximately 0.015 and 0.125 inches. In one or more embodiments, wire connectors may be flexible and capable of being rolled up. In other embodiments, wire connectors may be generally rigid. In one or more embodiments, connectors 16 may be made of plastic, metal or other suitable materials known to those skilled in the art. In certain embodiments, connectors 16 may be substantially rigid, meaning incapable of significant bending without breaking. In other embodiments, connectors 16 may be flexible and capable of bending and manipulation without breaking.

In one or more embodiments, each fastening plate 12 of fastening plate assembly 10 includes at least one connector 16 secured thereto and extending to an adjacent fastening plate 12, in other embodiments each fastening plate 12 includes at least two connectors 16 secured thereto and extending to adjacent fastening plates, and in other embodiments each fastening plate 12 includes at least three connectors 16 secured thereto and extending to adjacent fastening plates.

Figure 2:
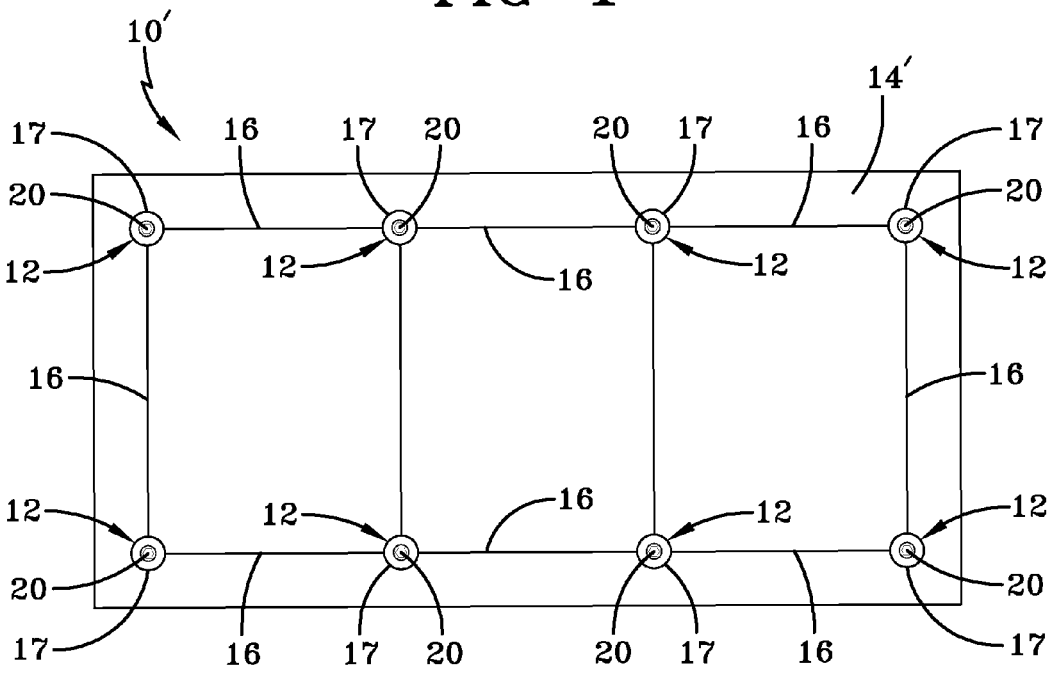
FIG. 2 is a top elevational view of an alternative embodiment of a fastening plate assembly according to the concepts of the present invention.

The embodiments of the invention shown in FIGS. 1 and 2 depict a fastening plate assembly adapted to secure a single construction board to a roof deck. Thus, fastening plate assemblies 10 and 10' are smaller than the top surface of construction boards 14 and 14', and cover only one construction board. However, it is also contemplated that a fastening plate assembly 10 according to the concepts of the present invention may extend between two or more adjacent construction boards 14. Thus, a single fastening plate assembly may be sized to cover 2, 3, 4, or any desired number of construction boards.

In one or more embodiments, the fastening plate assembly may be sized to cover an entire row of construction boards extending across a roof surface. In the same or other embodiments, the fastening plate assembly may be sized to cover 2 or more rows of construction boards extending across a roof surface. In certain embodiments, a single fastening plate assembly may be sized to cover the construction boards of an entire roofing assembly. Thus, in one or more fastening plate assemblies connectors 16 would extend between fastening plates 12 on adjacent construction boards 14.

Figure 4:
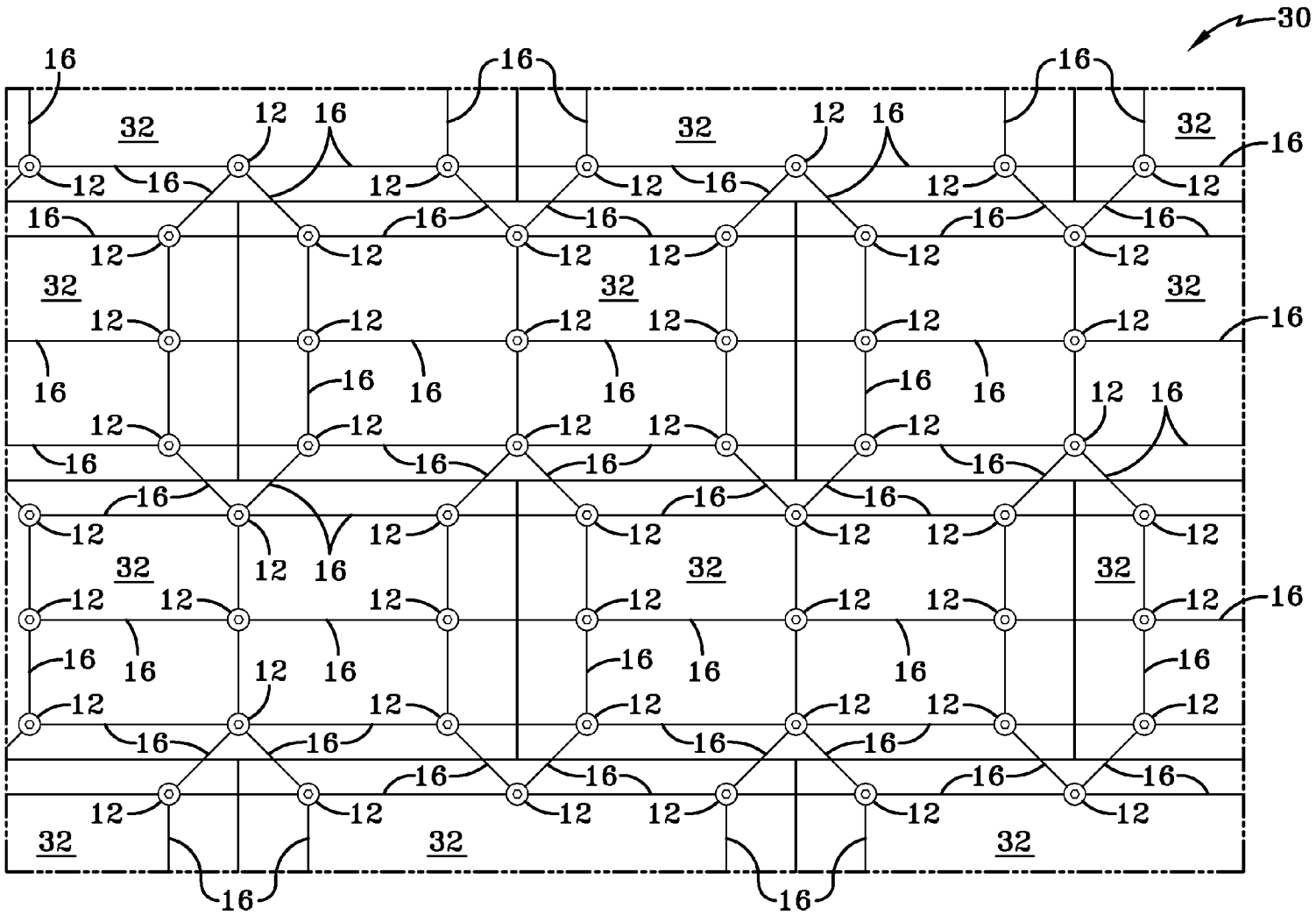
FIG. 4 is a top elevational view of a plurality of construction boards secured by an alternative embodiment of the fastening plate assembly according to the concepts of the present invention.
Figure 5:
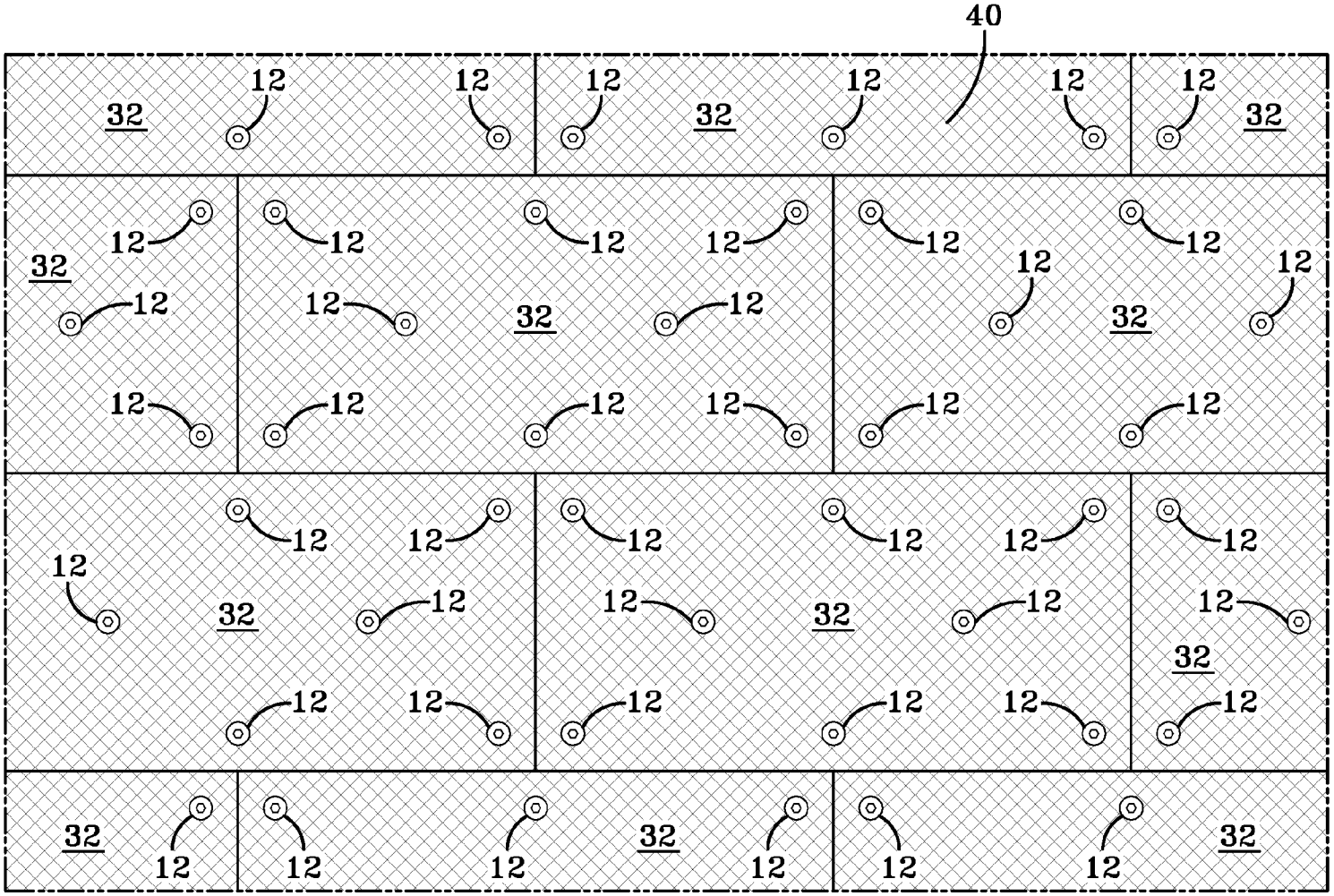
FIG. 5 is a top elevational view of a plurality of construction boards and another alternative embodiment of the fastening plate assembly according to the concepts of the present invention.

In one or more embodiments, connectors 16 may be flexible and capable of rolling. In certain embodiments, the flexible connectors 16 may allow for the creation of a fastening plate assembly 30 that may be unrolled over a plurality of construction boards 32 on a roofing surface. As shown in FIG. 4, one or more fastening plate assemblies 30 may be positioned over construction boards 32 to secure the construction boards to the roof deck. In one or more embodiments, the fastening plate assembly 30 may extend across the entire roof surface. In other embodiments, more than one fastening plate assembly 30 may be joined end to end or side to side to extend across the roof surface. In certain embodiments, a plurality of fastening plate assemblies 30, each having varying numbers of fastening plates 12, may be positioned at different locations over a roof surface to account for varying wind uplift forces at the various locations on the roof surface.

The connectors 16 of the insulation assembly 30 may extend between fastening plates 12 on adjacent construction boards 32, effectively connecting the two construction boards for purposes of wind uplift resistance. While a particular arrangement of fastening plates 12 and connectors 16 are shown in FIG. 4, it will be appreciated by those skilled in the art that numerous modifications may be made to the number, spacing and location of the fastening plates 12 of the fastening plate assembly 30. In addition, fastening plate assembly 30 may be manufactured in a variety of sizes to facilitate installation of the roofing system.

In one or more embodiments, fastening plate assembly 30 may be pre-manufactured at a factory and rolled for storage and shipping. In certain embodiments, fastening plate assembly 30 may be unrolled directly over construction boards 32 positioned on a roofing surface. In this way, technicians can install the fastening plates 12 over the construction boards 32 in less time and with less effort than with conventional methods. Furthermore, the inclusion of connectors 16 between fastening plates 12 ensures that the fastening plates are properly positioned and spaced from one another to provide optimal wind uplift resistance.

In an alternative embodiment, fastening plates 12 may be connected by plastic netting 40 positioned over construction boards 32. In this case, the plastic netting 40 acts as the connector extending between adjacent fastening plates 12. Plastic netting 40 may be provided in any desired pattern, and may be made of any suitable plastic. Suitable plastic nettings 40 for use with the present invention are available commercially, such as orange plastic safety netting used at constructions sites. For example, suitable plastic netting is available under the trade name Sentry Secura (U.S. Fence, Erie, Pa.). Plastic netting 40 may be unrolled over construction boards 32 in an overlapping arrangement so that substantially all of the construction boards 32 are covered by plastic netting 40. Fastening plates 12 may then be positioned over plastic netting 40 and construction boards 32 and installed conventionally. Like connectors 16, plastic netting 40 effectively connects the fastening plates 12 to transfer forces therebetween and thereby improve the wind uplift resistance of the roofing assembly.

In one or more embodiments, the construction boards 14 may be installed directly over a roof deck or roofing surface. The roof deck may be any suitable material, such as, for example, wood, concrete, and metal. The construction boards may be positioned end to end and edge to edge to cover substantially all of the roofing surface. In certain embodiments, two layers construction boards 14 may be provided. For example, insulation boards may be positioned immediately over the roof deck, and cover boards may be positioned over the insulation boards to provide additional thermal resistance and added protection. In other embodiments, cover boards may be installed over an existing roofing membrane assembly and prior to installation of a new roofing membrane assembly.

The fastening plate assembly of the present invention is positioned over the construction boards on the roof deck, and fasteners are driven through the fastening plates to secure the construction boards to the roof deck. In one or more embodiments, the fastening plate assembly may be positioned over a single construction board 14. In other embodiments, the fastening plate assembly may be sized to extend across multiple construction boards, and may be so positioned during installation. In certain embodiments, where connectors 16 are flexible, the fastening plate assembly may be unrolled over the construction boards during installation. In any case, once the fastening plate assembly is positioned as desired, the fasteners are driven through the fastening plates and the construction board and into the roof deck.

Various modifications and alterations that do not depart from the scope and spirit of this invention will become apparent to those skilled in the art. This invention is not to be unduly limited to the illustrative embodiments set forth herein.

The invention claimed is:

1. A pre-assembled fastening plate assembly comprising:

a plurality of fastening plates, wherein each said fastening plate is spaced apart and in a planar orientation with one another, each said fastening plate has an outer circumference and a central portion which has an aperture adapted to receive a fastener, wherein said central portion axially extends from said fastening plate a distance no more than said thickness of said fastening plate; and at least two wire connectors extending from each one of said plurality of fastening plates prior to use, wherein each said connector is connected to another fastening plate of said plurality of fastening plates, and wherein said at least two wire connectors are oriented at an angle other than 180° with respect to said fastening plate from which said at least two wire connectors extend and where said at least one wire connector is secured to and extends radially from said outer circumference of said fastening plates and wherein all said plurality of fastening plates and all said wire connectors are maintained in said planar orientation.

2. The fastening plate assembly of claim 1, where said wire connector includes a metal material and is welded to said fastening plates.

3. The fastening plate assembly of claim 1, where said wire has a diameter of between approximately 0.015 and 0.125 inches.

4. The fastening plate assembly of claim 1, where said wire connector is substantially rigid.

5. The fastening plate assembly of claim 1, where said wire connector is substantially flexible.

6. The fastening plate assembly of claim 1, where each said fastening plate has at least two wire connectors secured thereto, and wherein said wire connectors are oriented at angles of about 90° or 45° from each other.

7. A roofing system comprising:

a substantially planar construction board positioned over a roof deck;

a plurality of fastening plates and at least two wire connectors pre-assembled to said plurality of fastening plates and positioned on a top surface of said construction board, wherein each said fastening plate is spaced apart from one another and disposed on a planar orientation on said substantially planar board, each said fastening plate having a central portion which has an aperture adapted to receive a fastener, wherein said central portion axially extends from said fastening plate a distance no more than said thickness of said fastening plate; and wherein said at least two wire connectors extending from each one of said plurality of fastening plates wherein each said wire connector is connected to another fastening plate of said plurality of fastening plates, and wherein said at least two wire connectors are oriented at an angle other than 180° with respect to said fastening plate from which said at least two wire connectors extend, wherein all said connectors and all said fastening plates are positioned on said top surface of said construction board and are maintained in said planar orientation.

8. The roofing system of claim 7, where said fastener is received through said aperture, said fastener extending through said construction board and into said roof deck.

9. The roofing system of claim 8, where said wire connector is secured around said fastener.

10. The roofing system of claim 7, where each said fastening plate has an outer circumference and said wire connector is secured to and extends radially from said outer circumference.

11. The roofing system of claim 7, where said at least two wire connectors extend from each said fastening plate at angles of about 90° or 45° from each other.

12. A method of installing construction boards over a roof deck as part of a roofing system, the method comprising:

positioning a substantially planar construction board on a roof deck;

positioning a pre-assembled fastening plate assembly over the construction board, the fastening plate assembly including a plurality of fastening plates connected by at least two connectors, wherein each said fastening plate is spaced apart from one another and disposed in a planar orientation on said substantially planar construction board, each said fastening plate has an outer circumference and a central portion which has a centrally disposed aperture therethrough adapted to receive a fastener, wherein said central portion is raised axially extends from said fastening plate a distance no more than said thickness of said fastening plate, and each said fastening plate has said at least two wire connectors extending from said outer circumference of each one of said plurality of fastening plates wherein each said wire connector is connected to another fastening plate of said plurality of fastening plates, and wherein said at least two wire connectors are oriented at an angle other than 180° with respect to said fastening plate from which said at least two wire connectors extend, the fastening plates including an aperture therethrough and wherein all said plurality of fastening plates and all said wire connectors are maintained in said planar orientation to maintain contact with said substantially planar construction board; and driving a fastener through the aperture in each fastening plate and the construction board and into the roof deck.

13. The method according to claim 12, further comprising:

extending said at least two wire connectors at angles of about 90° or 45° from each other.

14. A fastening plate assembly, comprising:

a plurality of fastening plates pre-assembled to one another with at least two connectors, each said fastening plate spaced apart from one another and wherein each said fastening plate has a central aperture adapted to receive a fastener therethrough.

15. The fastening plate assembly according to claim 14, wherein each said fastening plate has a raised central portion axially extending from said fastening plate a distance no more than a thickness of said fastening plate.

16. The fastening plate assembly according to claim 14, wherein each said fastening plate has an outer circumference from which a corresponding said connector extends.

17. The fastening plate assembly according to claim 14, wherein said at least two connectors are flexible to allow the assembly to be rolled for storage and then unrolled for installation.

18. The fastening plate assembly according to claim 17, wherein said connectors are wire and flexible.

19. The fastening plate assembly according to claim 14, wherein each said fastening plate has a central portion through which said aperture extends, said central portion axially extends from said fastening plate a distance no more than said thickness of said fastening plate.

* * * * *